United States Patent [19]

Choy et al.

[11] Patent Number: 4,762,513

[45] Date of Patent: Aug. 9, 1988

[54] RECONFIGURABLE WALKING TOY WITH GEAR MECHANISM

[75] Inventors: Terence A. Choy, Redondo Beach; Harold A. Hartleben, Boyle Heights, both of Calif.; Jaime Serna, Barcelona, Spain

[73] Assignee: Mattel, Inc., Hawthorne, Calif.

[21] Appl. No.: 881,890

[22] Filed: Jul. 3, 1986

[51] Int. Cl.[4] ..... A63H 7/00

[52] U.S. Cl. ..... 446/359; 446/378

[58] Field of Search ..... 446/352, 353, 354, 355, 446/368, 377, 333, 359, 378

[56] References Cited

U.S. PATENT DOCUMENTS

| | | | |
|---|---|---|---|
| Des. 240,250 | 6/1976 | Ptaszek | D21/130 |
| Des. 266,777 | 11/1982 | Lucas, Jr. et al. | D21/134 |
| Des. 268,942 | 5/1983 | Lucas, Jr. et al. | D21/150 |
| Des. 272,752 | 2/1984 | Boudreaux | D21/87 |
| Des. 277,398 | 1/1985 | Johnston | D21/87 |
| Des. 278,733 | 5/1985 | Ohkado | D21/150 |
| Des. 278,838 | 5/1985 | Ohkado | D21/150 |
| 2,124,667 | 7/1938 | Davis | 446/377 |
| 2,503,707 | 4/1950 | Braman | 446/230 |
| 2,622,368 | 12/1952 | Gerbaud | 446/377 |
| 2,761,243 | 9/1956 | Baggott | 446/377 |
| 2,859,554 | 11/1958 | Walss | 446/353 |
| 2,883,795 | 4/1959 | Baggott | 446/377 |
| 2,887,822 | 5/1959 | Baggott | 446/377 |
| 2,996,837 | 8/1961 | Beebe | 446/377 |
| 3,147,566 | 9/1964 | Ong | 446/377 X |
| 3,468,056 | 9/1969 | Gardel et al. | 446/377 |
| 3,475,042 | 10/1969 | Speers et al. | 446/378 X |
| 3,594,947 | 7/1971 | Hartling et al. | 446/268 |
| 4,006,555 | 2/1977 | England et al. | 446/354 X |
| 4,182,075 | 1/1980 | James | 446/354 X |
| 4,244,141 | 1/1981 | Douglas et al. | 446/355 |
| 4,248,006 | 2/1981 | Jones et al. | 446/89 |

FOREIGN PATENT DOCUMENTS

| | | | |
|---|---|---|---|
| 536046 | 11/1955 | Italy | 446/276 |

*Primary Examiner*—Robert A. Hafer
*Assistant Examiner*—Samuel Rimell
*Attorney, Agent, or Firm*—Ronald M. Goldman; Melvin A. Klein; Daniel F. Sullivan

[57] ABSTRACT

A reconfigurable walking toy which may be operated by turning a control knob which activates a gear mechanism within the toy used to move the leg members of the toy in order to simulate a walking action. The toy has two leg members, each having upper and lower leg members. The two upper leg members are rotatably engaged to a hollow body. Each of the two lower leg members is rotatably engaged to one of the upper leg members. The toy is supported by foot members which rotatably engage the bottom ends of the lower leg members. The gear mechanism features two sector gears which are rotatably mounted to the hollow body of the toy. The sector gears are driven by a pinion gear attached to a gear shaft. A control knob is used to rotate the shaft. Rotation of the knob back and forth causes one leg member to stride forward followed by the other leg member, simulating a walking movement of the toy. Tabs attached to the upper leg members operably engage elongated slots in the hollow body when the toy is in a walking configuration supported by the foot members. The toy can be reconfigured to simulate a flying vehicle or craft by rotating the upper ends of the leg members until the tabs engage smaller slots in the hollow body, locking the legs in a substantially horizontal position.

5 Claims, 3 Drawing Sheets

RECONFIGURABLE WALKING TOY WITH GEAR MECHANISM

BACKGROUND OF THE INVENTION

The present invention relates generally to walking toys and, more particularly, to a reconfigurable walking toy which a child may operate by turning a control knob that activates a gear mechanism within the toy used to move the legs of the toy in order to simulate a walking action.

In the past, various walking and/or crawling dolls have been manufactured such as those described in U.S. Pat. Nos. 3,468,056 issued Gardel et al on Sept. 23, 1969; 2,996,837 issued to Beebe on Aug. 22, 1961; 2,859,554 issued to Walss on Nov. 11, 1958; and 2,761,243 issued to Baggott on Sept. 4, 1956. A toy walking animal is disclosed in U.S. Pat. No. 2,124,667 issued to Davis on July 26, 1938. Other toys having legs or appendages are shown in U.S. Design Pat. Nos. Des. 278,838 issued to Ohkado on May 14, 1985; Des. 278,733 issued to Ohkado on May 7, 1958; Des. 272,752 issued to Boudreaux on Feb. 21, 1984; Des. 268,942 issued to Lucas, Jr. et al on May 10, 1983; and Des. 266,777 issued to Lucas, Jr. et al on Nov. 2, 1982. U.S. Pat. No. 3,594,947 issued to Hartling et al on July 27, 1971 describes a spaceman carrier toy supported on stilt members. Simulated vehicles or crafts are shown in U.S. Design Pat. Nos. Des. 240,250 issued to Ptaszek on June 8, 1976 and Des. 277,398 issued to Johnson on Jan. 29, 1985. Finally, reconfigurable toys are disclosed in U.S. Pat. Nos. 4,248,006 issued to Jones et al on Feb. 3, 1981 and 2,503,707 issued to Braman on Apr. 11, 1950.

None of the above patents describes a reconfigurable walking toy which a child may operate by turning a control knob that activates a gear mechanism within the toy used to move the legs of the toy in order to simulate a walking action. Such a toy would be particularly enjoyable to a child if it could be reconfigured to simulate a flying vehicle or craft. This feature would present additional play options for the child. Accordingly, there is a need in the toy manufacturing arts for a reconfigurable walking toy which may be operated by turning a control knob.

SUMMARY OF THE INVENTION

It is an object of this invention to provide a reconfigurable walking toy.

It is another object of this invention to provide a reconfigurable walking toy featuring a gear mechanism which may be activated by turning a control knob on the toy back and forth to move the legs of the toy in order to simulate a walking movement of the toy.

It is still another object of this invention to provide a reconfigurable walking toy which may be reconfigured to simulate a flying vehicle or craft.

These and other objects and advantages are attained by a reconfigurable walking toy which may be operated by turning a control knob which activates a gear mechanism within the toy used to move the leg members of the toy in order to simulate a walking action. The toy has two leg members, each having upper and lower leg members. The two upper leg members are rotatably engaged to a hollow body. Each of the two lower leg members is rotatably engaged to one of the upper leg members. The toy is supported by foot members which rotatably engage the bottom ends of the lower leg members. The gear mechanism features two sector gears which are rotatably mounted to the hollow body of the toy. The sector gears are driven by a pinion gear attached to a gear shaft. A control knob is used to rotate the shaft. Rotation of the knob back and forth causes one leg member to stride forward followed by the other leg member, simulating a walking movement of the toy. Tabs attached to the upper leg members operably engage elongated slots in the hollow body when the toy is in a walking configuration supported by the foot members. The toy can be reconfigured to simulate a flying vehicle or craft by rotating the upper ends of the leg members until the tabs engage smaller slots in the hollow body, locking the legs in a substantially horizontal position.

The various features of the present invention will be best understood, together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
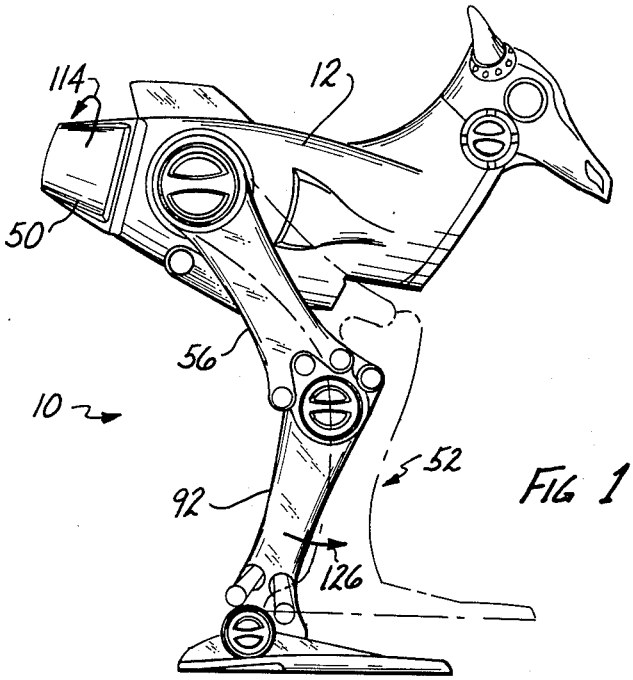
FIG. 1 is a side elevational view of a reconfigurable walking toy of the present invention.
Figure 3:
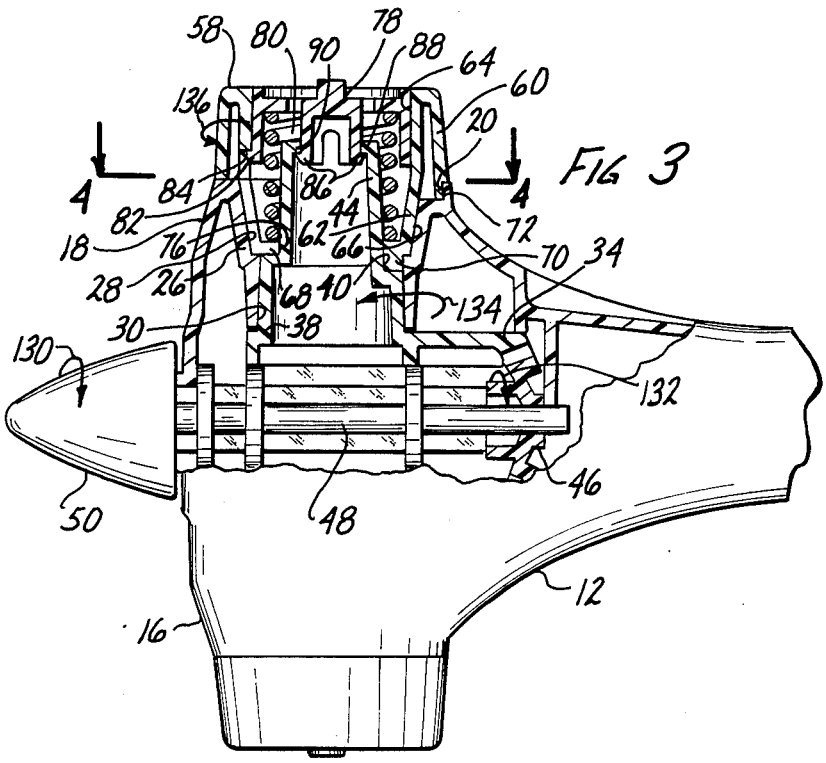
FIG. 3 is a partial cross-sectional view of the upper leg joint of the reconfigurable walking toy of FIG. 1 with part of the toy broken away to illustrate how a gear mechanism inside the toy operates.
Figures 2, 6:
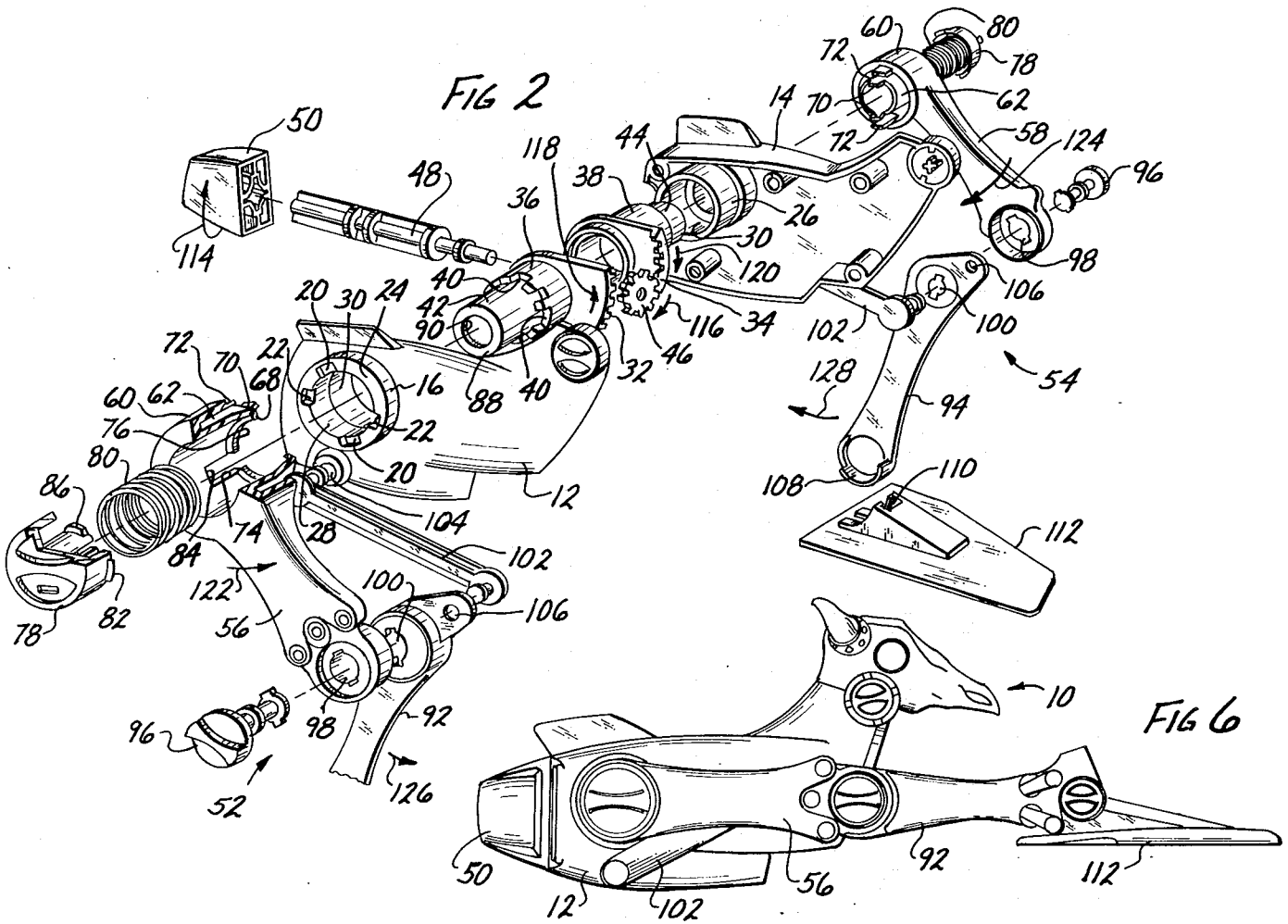
FIG. 2 is an exploded perspective view of the reconfigurable walking toy of FIG. 1.
FIG. 6 is a side elevational view of the reconfigurable walking toy of FIG. 1 showing how the toy can be reconfigured to simulate a flying vehicle or craft.
Figure 4:
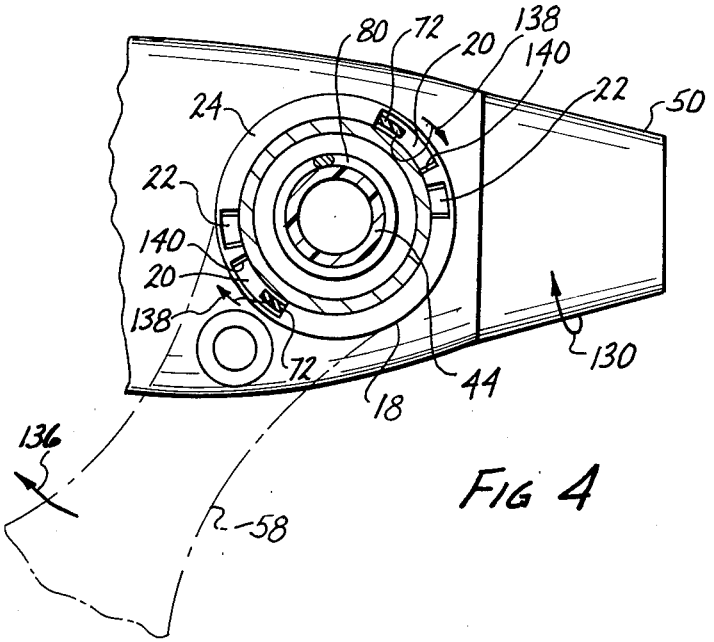
FIG. 4 is a partial cross-sectional view taken in the direction of the arrows 4—4 shown in FIG. 3.
Figure 5:
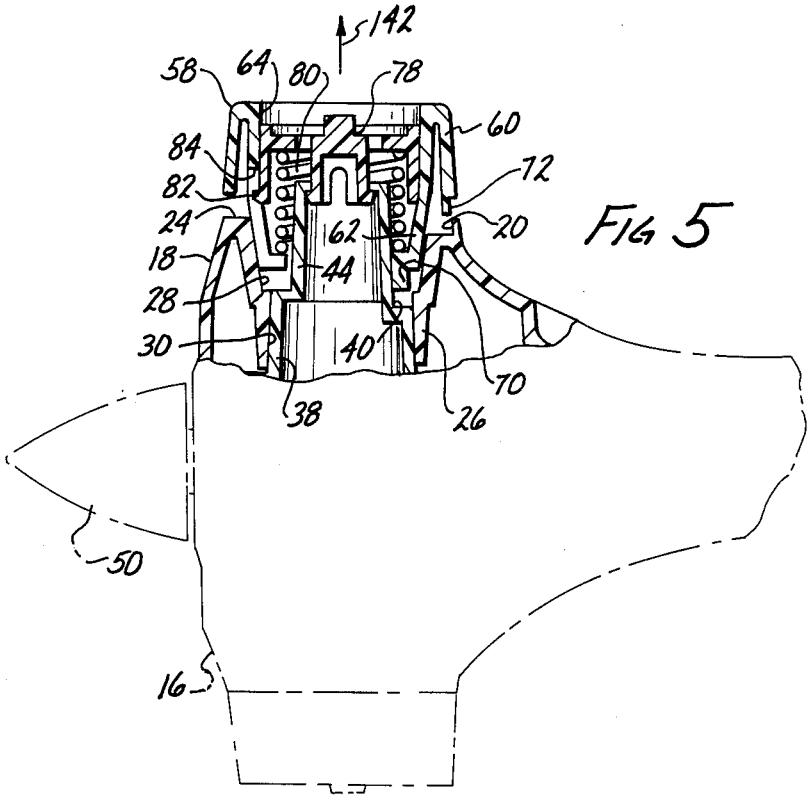
FIG. 5 is a partial cross-sectional view of the upper leg joint of the reconfigurable walking toy of FIG. 1 with part of the toy broken away to illustrate how an upper leg member can be pulled outward and rotated to reposition one of the legs of the toy.

Referring now to the drawings and particularly to FIGS. 1 and 2, a preferred embodiment of the reconfigurable walking toy 10 of present invention is disclosed. The toy 10 has hollow body parts 12 and 14 which may be attached together any convenient manner such as by pin and socket connectors. Both body parts 12 and 14 have outwardly extending portions 16 and 18, respectively, as shown in FIGS. 3 and 5. The outwardly extending portions 16 and 18 have two smaller slots 22 at the outer edges 24 thereof (see FIGS. 2 and 4). Each of the portions 16 and 18 has an inwardly extending portion 26 with a tapered inside surface 28 and a generally cylindrically-shaped inside surface 30 as shown in FIGS. 3 and 5. Preferably, inside surface 30 is slightly tapered.

Two sector gears 32 and 34 are rotatably mounted inside the toy 10 by generally cylindrically-shaped extensions 36 and 38 attached to the gears which rotatably engage the inside surfaces 30 of the portions 26. The extensions 36 and 38 have a plurality of slots 40 as shown in FIG. 2. Attached to the extensions 36 and 38 are generally cylindrically-shaped extensions 42 and 44. Extensions 36, 38, 42 and 44 are preferably slightly tapered.

A pinion gear 46 mounted on a gear shaft 48 engages both sector gears 32 and 34. The shaft 48 and gear 46 may be manually rotated by a central knob 50 attached to the shaft.

The toy 10 has two legs 52 and 54 having upper leg members 56 and 58, respectively. The legs 52 and 54 are coupled to body parts 12 and 14 at upper leg joints as shown in FIG. 3. The upper end of each leg has a generally cylindrically-shaped outer portion 60 and an inner portion 62. As best shown in FIG. 2, outer portion 60 has two tabs 72 extending from one end thereof and inner portion 62 has two tabs 70 attached to flange 68 of inner portion 62. In addition, inner portion 62 has slot 74 passing through it (see FIG. 2).

In order to better illustrate the upper leg joints, the partial cross-sectional views shown in FIGS. 3 and 5 are taken across the slot 74 and one each of the tabs 70 and 72. When assembled, inner portion 62 rotatably engages inwardly extending portion 26 as shown in FIG. 3. Surfaces 28 and 66 are formed or shaped to allow such engagement. In addition, cylindrically-shaped extension 42 and 44 engage apertures formed by flanges 68 (see FIG. 2). Both upper leg joints are held together by upper connectors 78 which fit inside the inner portions 62 and extensions 42 and 44 connector 78 slidably engage the inside surfaces 64 of inner portions 62 during repositioning of leg members 52 and 54 (see FIGS. 3 and 5) for the purpose of reconfiguring the toy 10 into the flying configuration shown in FIG. 6, as will be explained later. The connectors 78 also slidably engage apertures 90 formed by flanges 88. Springs 80 bias the connectors 78 outward from extensions 42 and 44, causing protuberances 82 on the connectors 78 to contact edges 84 of the slots 74 and protuberances 86 of the connectors 78 to contact flanges 88 of the extensions 42 and 44, as best shown in FIG. 3.

The springs 80 also force tabs 70 into engagement with slots 40 so that rotation of the cylindrical extensions 36 and 38 will cause the upper leg members 56 and 58 to rotate. In addition, the springs 80 force tabs 72 into elongated slots 20.

Lower leg members 92 and 94 are rotatably connected to the lower ends of the upper leg members 56 and 58, respectively, by lower connectors 96 which engage apertures 98 and 100 in the upper and lower leg members, respectively. Struts 102 assist in supporting the leg members 52 and 54. The ends of the struts 102 are rotatably coupled to the body parts 12 and 14 and lower leg members 92 and 94 at apertures 104 and 106, respectively. Each of the lower leg members 92 and 94 has a curved portion 108 attached thereto as shown in FIG. 2. Portions 108 are curved or shaped in order to slidably engage curved channels 110 in foot members 112 in such a way that members 112 are free to rotate with respect to members 92 and 94.

After the toy 10 is assembled, the control knob 50 may be rotated in either direction. If the knob 50 is rotated in the direction of arrow 114 shown in FIG. 2, then shaft 48 will cause pinion gear 46 to rotate as indicated by arrow 116. Gear 46, in turn, will cause sector gears 32 and 34 to rotate as indicated by arrows 118 and 120, respectively. Rotation of the sector gears 32 and 34 will result in corresponding rotation of cylindrical extensions 36 and 38. Since tabs 70 engage slots 40, rotation of extensions 36 and 38 will cause upper leg members 56 and 58 to rotate as illustrated by arrows 122 and 124, respectively. Lower leg members 92 and 98 will then rotate as indicated by arrows 126 and 128, respectively (see also FIG. 1).

If the control knob 50 is turned opposite to that shown in FIG. 2, then the leg members 56, 58, 92 and 94 will all rotate in directions opposite to those shown in FIG. 2. This is illustrated in FIGS. 3 and 4. When the knob 50 is rotated in the direction of arrow 130, the pinion gear 46, cylindrical extension 38 and upper leg member 58 will rotate in accordance with arrows 132, 134 and 136, respectively.

FIG. 4 illustrates how tabs 72 engage the elongated slots 20. When knob 50 is rotated in the direction of arrow 130, tabs 72 will rotate within slots 20 as illustrated by arrows 138 until the tabs come into contact with edges 140 of the slots. As such, the rotation of leg members 52 and 54 is limited by the length of the slots 20. This feature limits the stride of the leg members or the rotation of knob 50 when the toy is used in the walking configuration as discussed below.

The above discussion has assumed that the foot members 112 are not resting on a surface when the control knob 50 is rotated. If foot members 112 are supported on a surface when knob 50 is rotated in the direction shown in FIGS. 1 and 2, then member 112 of leg member 54 will remain stationary due to downward forces acting on lower leg member 94 while member 112 of leg member 52 will be lifted and moved forward due to upward forces acting on lower leg member 92. The knob 50 may then be rotated in a direction opposite to arrow 114, causing leg member 54 to stride forward while leg member 52 remains in place. As a result, the toy 10 appears to be walking as the leg members 52 and 54 stride forward. Rotation of the knob in opposite directions may be repeated as often as desired to provide a continuous walking movement of the toy.

FIG. 6 shows how the toy 10 can be reconfigured to simulate a flying vehicle or aircraft. This reconfiguration is accomplished by simply pulling the upper leg members 56 and 58 outward from the body parts 12 and 14 (e.g., pulling member 58 in the direction of arrow 142 shown in FIG. 5) until the tabs 72 are no longer engaging slots 20 and then rotating the members 56 and 58 until the tabs 72 can be inserted into slots 22. Note how the spring 80 will be compressed as shown in FIG. 5 when upper leg member 58 is pulled outward, allowing connectors 78 to slidably engage inside surfaces 64 of members 58 and tabs 72 to slide free of slots 20. When the toy 10 is changed into a flying configuration, leg members 52 and 54 will be locked in a substantially horizontal position as illustrated in FIG. 6. Struts 102 help to support the leg members while in this configuration. The foot members 112 will rotate to a substantially horizontal position when the leg members are positioned as shown in FIG. 6.

The toy 10 may be changed back into the walking configuration shown in FIG. 1 by pulling the upper leg members 56 and 58 outward again until tabs 72 are free of slots 22 and rotating the members 56 and 58 until the tabs 72 can be reinserted into elongated slots 20.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A walking toy comprising:

a hollow body having two apertures passing therethrough and a plurality of elongated and shorter slots therein;

two upper leg members, each of said upper leg members having at least one tab attached thereto and one end thereof rotatably engaging one of said apertures in said hollow body, each of said tabs capable of selectively and releasably engaging one of said elongated slots and one of said shorter slots;

two lower leg members, each of said lower leg members having one end thereof rotatably engaging the other end of one of said upper leg members forming a pair of one upper leg member and one lower leg member.

two foot members, each of said foot members being rotatably engaged to the other end of one of said two lower leg members, said foot members capable of supporting said walking toy on a surface; and gear means rotatably mounted inside said hollow body for simultaneously moving said pairs of upper and lower leg members in opposite directions in order to simulate a walking action when said walking toy is supported by said foot members on said surface, said upper leg members capable of being pulled outward from said hollow body and of being rotated so that said tabs may selectively engage said elongated slots in order to support said walking toy on said foot members and said shorter slots to dispose said pairs of upper and lower members in a substantially horizontal position.

2. The walking toy of claim 1 wherein said gear means comprises:

a gear shift;

a pinion gear attached to said shaft; and two sector gears engaged to said pinion gear.

3. The walking toy of claim 2 further comprising control knob means for turning said gear shaft.

4. The walking toy of claim 3 wherein each one of said upper leg members has a connector engaged to said one upper leg member and to an extension of one of said sector gears, and spring means trapped inside said connector and said one upper leg member for biasing each of said tabs into a corresponding one of said slots.

5. A reconfigurable walking toy comprising:

a hollow body having two outwardly extending portions having an aperture, at least one elongated slot and at least one shorter slot therein;

two upper leg members, each of said upper leg members having at least one outer tab attached thereto and an inner portion at one end thereof rotatably engaged to one of said apertures in said outwardly extending portions, each of said inner portions having a slot therein, a flange at the end thereof forming an aperture and at least one inner tab attached to said flange, each of said outer tabs capable of selectively and releasably engaging one of said elongated slots and one of said shorter slots;

two lower leg members, each of said lower end members having one end thereof rotatably engaging the other end of one of said upper leg members forming a pair of one upper leg member and one lower leg member and having a curved portion attached to the other end thereof;

two foot members, each of said foot members having a curved channel therein and being rotatably engaged to one of said lower leg members by one of said curved portions which slidably engages said curved channel so that said foot members are capable of supporting said walking toy on a surface;

two struts, each of said struts having one end thereof rotatably engaged to said hollow body and the other end thereof rotatably engaged to one of said lower leg members;

two sector gears, each of said sector gears having engaging slots therein and a cylindrical extension rotatably engaging one of said apertures in one of said outwardly extending portions and one of said apertures formed by one of said flanges of one of said inner portions, each of said inner tabs capable of selectively and releasably engaging one of said engaging slots, each of said cylindrical extensions having a flange at the end thereof forming an aperture;

a pinion gear engaged to said sector gears;

a gear shaft attached to said pinion gear;

two connectors, each of said connectors engaged to one of said inner portions of one of said upper leg members and to one of said cylindrical extensions of one of said sector gears;

two springs, each of said springs being trapped inside one of said connectors and one of said inner portions, each of said springs being disposed around one of said cylindrical extensions and biasing one of said connectors outward from one of said cylindrical extensions causing protuberances of said connectors to engage said slots. in said inner portions and said flanges of said cylindrical extensions; and control knob means attached to said gear shaft for selectively rotating said pinion gear in opposite directions so that said pairs of upper and lower leg members are simultaneously moved in opposite directions in order to simulate a walking action when said walking toy is supported by said foot members on said surface, said movement of said upper and lower leg members being restricted by the size of said elongated slots of said outwardly extended members, said walking toy being supported by said foot members when said outer tabs of said upper leg members are engaging said elongated slots and said pairs of upper and lower leg members being disposed in a substantially horizontal position when said outer tabs are engaging said shorter slots of said outwardly extending members, said upper leg members capable of being pulled outward from said hollow body against the force of said springs and of being rotated so that said outer tabs may selectively engage said elongated slots in order to support said walking toy on said foot members and said shorter slots to dispose said pairs of upper and lower leg members in said substantially horizontal position.

* * * * *